US007510259B2

(12) United States Patent
Geer

(10) Patent No.: US 7,510,259 B2
(45) Date of Patent: Mar. 31, 2009

(54) CALIBRATING TURN-ON ENERGY OF A MARKING DEVICE

(75) Inventor: Derek Geer, Clearwater, FL (US)

(73) Assignee: Eastman Kodak Company, Rochester, NY (US)

( * ) Notice: Subject to any disclaimer, the term of this patent is extended or adjusted under 35 U.S.C. 154(b) by 200 days.

(21) Appl. No.: 11/613,435

(22) Filed: Dec. 20, 2006

(65) Prior Publication Data

US 2008/0150994 A1 Jun. 26, 2008

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,418,558 | A * | 5/1995 | Hock et al. | 347/14 |
| 5,428,376 | A | 6/1995 | Wade et al. | 347/14 |
| 5,526,027 | A * | 6/1996 | Wade et al. | 347/14 |
| 5,642,142 | A * | 6/1997 | Bohorquez | 347/15 |
| 5,682,185 | A * | 10/1997 | Wade et al. | 347/19 |
| 5,726,690 | A * | 3/1998 | Bohorquez et al. | 347/15 |
| 5,751,302 | A * | 5/1998 | Rezanka | 347/9 |
| 6,244,682 | B1 | 6/2001 | Walker et al. | 347/19 |
| 6,377,358 | B1 * | 4/2002 | Hayasaki et al. | 358/1.16 |
| 6,454,376 | B1 * | 9/2002 | Su et al. | 347/9 |
| 6,629,789 | B2 * | 10/2003 | Kawatoko | 400/74 |
| 6,669,324 | B1 | 12/2003 | King et al. | 347/19 |
| 2003/0218648 | A1 | 11/2003 | Barnes et al. | 347/19 |
| 2004/0085384 | A1 | 5/2004 | Ju et al. | |
| 2004/0263548 | A1 * | 12/2004 | Koehler et al. | 347/10 |
| 2005/0078136 | A1 | 4/2005 | Barnes et al. | 347/19 |
| 2006/0187256 | A1 | 8/2006 | Ito | |
| 2006/0203028 | A1 * | 9/2006 | Agarwal et al. | 347/19 |

FOREIGN PATENT DOCUMENTS

| | | |
|---|---|---|
| EP | 0 925 925 | 6/1999 |

* cited by examiner

*Primary Examiner*—Julian D Huffman
(74) *Attorney, Agent, or Firm*—Justin D. Petruzzelli

(57) ABSTRACT

In a system and a method for calibrating turn-on energy of a fluid-ejecting marking device, a reference object and a plurality of test objects are contemporaneously printed by the marking device on a same type of substrate. The reference object is printed at a known "on" voltage at a first pattern density, and the test objects are printed at a series of decrementing voltages at an intended second pattern density greater than the first pattern density. A scanning device compares the reference object to the test objects to determine which test object(s) most closely resemble(s) the reference object. Based at least upon this comparison, a turn-on energy for the marking device is determined. By using a reference object to compare the test objects to, a turn-on energy can be calculated independent of the type of substrate used and the ambient conditions present when printing the reference and test objects.

30 Claims, 9 Drawing Sheets

Marking Percent vs. Delivered Energy

CALIBRATING TURN-ON ENERGY OF A MARKING DEVICE

FIELD OF THE INVENTION

This invention relates to calibrating turn-on energy of a fluid-ejecting marking device. In particular, the present invention relates to calibrating a voltage level at which fluid-providing nozzles of the marking device reliably fire.

BACKGROUND OF THE INVENTION

FIG. 1 illustrates a conventional inkjet printing system 1 including an ink jet printhead 10, which is an example of an ink-ejecting marking device. The ink jet printhead 10 includes an ink-reservoir 19 with a plurality of nozzles 30 communicatively connected thereto via channels (32 for example), through which ink in the reservoir 19 is ejected in the form of drops (33, for example) from drop generators (not shown) onto a substrate 20. Depending upon the contents of an image 12 to be formed on the substrate 20, a driving circuit 14 selectively applies a voltage waveform via an electrical pulse source 16 to the drop generators corresponding to particular nozzles of the nozzles 30. This selective application of a voltage waveform causes drops of ink (33, for example) to be ejected from the particular nozzles, thereby causing the image to be formed on the substrate 20. Conventionally, each drop generator is a heater resistor (not shown) having a resistance R. For a waveform consisting of a constant voltage pulse amplitude V and a pulsewidth t, for example, the power dissipated in the heater resistor is $V^2/R$, and the energy dissipated in the heater resistor is $V^2t/R$.

If the voltage applied by the controller 14 via the electrical pulse source 16 to the nozzles 30 is too high, the operational life of the inkjet printhead 10 is reduced, thereby causing premature failure. On the other hand, if the applied voltage is too low, the nozzles 30 will not fire reliably or will not fire at all. Accordingly, it is important in the art to be able to determine an appropriate voltage to be applied to the nozzles that reliably will cause the nozzles to fire while not excessively harming the operational life of the inkjet printhead 10.

One conventional scheme for determining an appropriate applied voltage is illustrated with FIG. 2. This conventional scheme involves printing a sequence of swatches 101, each having a same pattern-density (i.e., a same number of nozzles selected to be fired), but each being printed with a successively different applied-voltage. In the example of FIG. 2, the first swatch 102 is printed with a high voltage that fires all selected nozzles, and each successive swatch thereafter is printed with a slightly lower voltage until the last swatch 103 is printed with such a low voltage that none or a small percentage of the selected nozzles fire. (It should be noted that the texture of the swatches 101 shown in FIG. 2 is used merely to illustrate a change in reflectance of each swatch and is not used to illustrate exactly which nozzles fired and which did not.)

Continuing with the example of FIG. 2, the sequence of swatches 101 is then scanned by an optical scanner to determine which swatch exhibits a reflectance that is substantially lower than the previous swatch, in order to determine the voltage at which most nozzles reliably fire. To elaborate, FIG. 3 illustrates a graph of voltage applied to the selected nozzles versus reflectance of a swatch generated at that voltage. Although the graph of FIG. 3 illustrates a continuous function, a graph generated by data provided by the optical scanner reading the swatches illustrated in FIG. 2 would have discrete points 201-210, for example. The optical scanner reads the reflectance of the first swatch 102 to determine point 210, for example. Then, the optical scanner reads the reflectance of the second swatch to determine point 209, and so on. To determine an appropriate applied voltage, the first substantial difference between reflectances at successive points from point 201 to point 210 that exceeds a predetermined amount is flagged, and a point between the points that resulted in the first substantial difference of reflectances is selected as the appropriate applied voltage. In the example of FIG. 2, the difference in reflectances between the second swatch, corresponding to point 209 and the third swatch, corresponding to point 208 may be selected as the points that produce the first substantial difference in reflectance. Accordingly, a voltage inclusively between the voltages corresponding to points 209 and 208 may be selected as the appropriate applied voltage. Depending upon how the printhead 10 is to be calibrated, however, the reflectance difference between points 209 and 208 may not be substantial enough and, for example, the reflectance drop between points 208 and 207 instead may be used to determine the appropriate applied voltage.

A draw back of this conventional scheme is that measuring the reflectance of the swatches is dependent upon characteristics of the substrate upon which the swatches are printed. In particular, ink spreads and interacts differently depending upon the substrate being used. Accordingly, reflectance measurements for the same sequence of swatches will be different depending upon the substrate on which the swatches are printed. Further, reflectance measurements of swatches also are dependent upon ambient conditions, such as humidity and temperature. Accordingly, the same sequence of test swatches printed on the same type of substrate often are different depending upon the humidity and/or temperature of the environment in which they are printed. Accordingly, a need in the art exists for a method of determining an appropriate applied voltage that is independent of or reduces the impact of these factors.

SUMMARY OF THE INVENTION

The above-described problems are addressed and a technical solution is achieved in the art by a system and a method for calibrating turn-on energy ("TOE"), such as a voltage, of a fluid-ejecting marking device, according to embodiments of the present invention. In an embodiment of the present invention, a reference object is printed with the marking device on a substrate of a first type. Additionally, a plurality of test objects are printed with the marking device on a substrate of the first type at various or successive energy levels. The test objects may be printed contemporaneously or substantially contemporaneously with the printing of the reference object. After printing the reference object and the test objects, at least one of the test objects of the plurality of test objects is selected that closely resemble(s) the reference object. According to an embodiment of the present invention, the test object(s) that most closely resemble(s) the reference object is/are the test object(s) that have (a) more similar reflectance(s) to the reference object than other test objects. The energy level(s) used to print the selected test object(s) is/are used to facilitate determining a TOE for use with the marking device.

By comparing the test objects to the reference object printed on a same type of substrate, a determination of TOE may be made independent of substrate characteristics. Further, by printing the test objects and the reference object contemporaneously or substantially contemporaneously and comparing them, a determination of TOE may be made independent of ambient conditions, such as humidity and/or temperature.

According to an embodiment of the present invention, the reference object is printed at a first pattern density, and the plurality of test objects are printed at an intended second pattern density, the intended second pattern density having a pattern density greater than the first pattern density. According to an embodiment of the present invention, the first pattern density is approximately a 12.5% density checkerboard pattern. Further, according to an embodiment of the present invention, the intended second pattern density is approximately a 25% density checkerboard pattern. Additionally, according to an embodiment of the present invention, the reference object and the test objects are a sequence of swatches printed in a row.

According to an embodiment of the present invention, the fluid-ejecting marking device is an inkjet printing device and the fluid is ink.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention include determining a turn-on energy ("TOE"), such as a voltage, for a fluid-ejecting marking device by, among other things, comparing a reference object to a plurality of test objects, all of which have been printed by the marking device being calibrated. The reference object, which may be a swatch according to an embodiment of the present invention, may be printed at a voltage $V_o$, which is known to reliably fire all or nearly all of the nozzles of the marking device. The test objects, which also may be swatches, are printed at a variety of different voltage levels. The reference object and the test objects may be printed on a same type of substrate to avoid the effects of fluid interacting differently with different types of substrates. Also, the reference object and the test objects may be printed contemporaneously or substantially contemporaneously to avoid the effects of objects being printed under different ambient conditions. Accordingly, a reliable TOE may be determined regardless of the type of substrate used and/or ambient conditions present.

Figure 4:
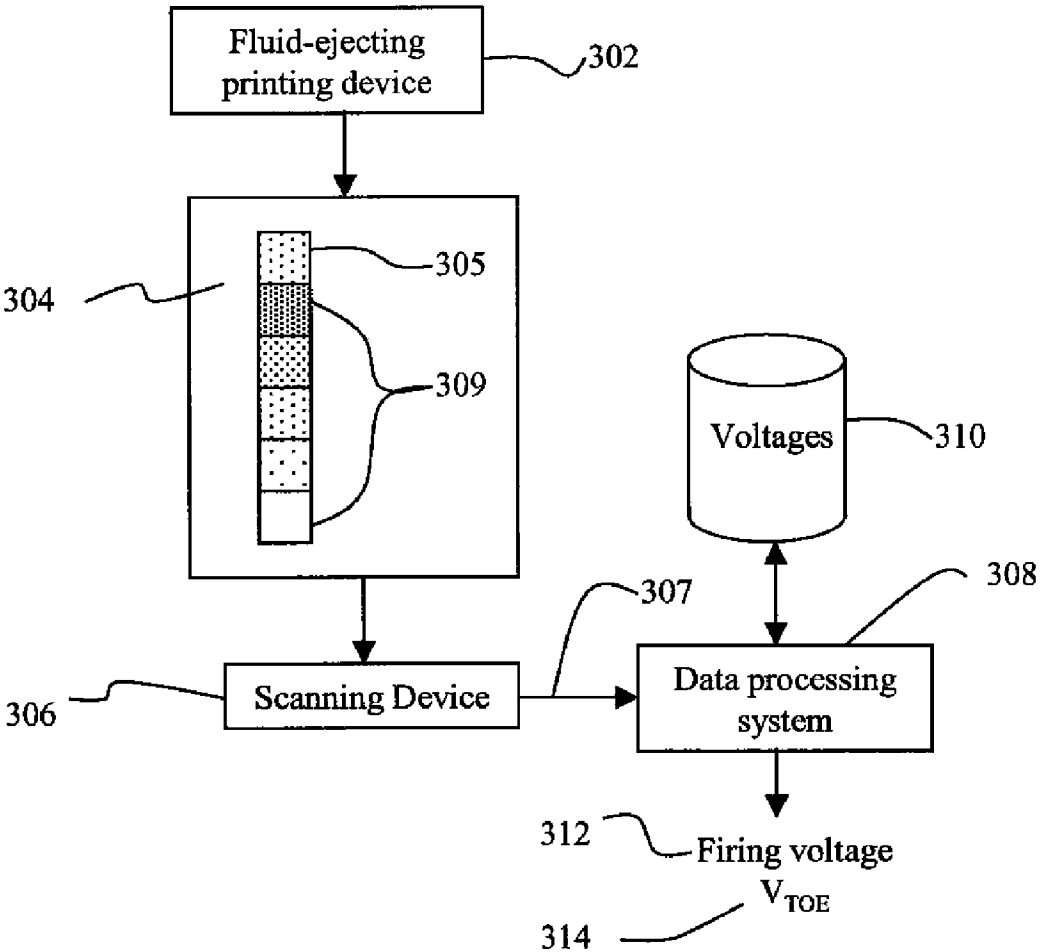
FIG. 4 illustrates a system for calibrating turn-on energy of a marking device, according to an embodiment of the present invention.

To elaborate, FIG. 4 will be described, which illustrates a system 300 for calibrating turn-on energy of a marking device, according to an embodiment of the present invention. In particular, a fluid-ejecting marking device 302, such as an ink-jet printer that ejects ink, prints a sheet 304 that includes a reference object 305 and a plurality of test objects 309. Although a single sheet 304 including all objects 305, 309 is illustrated for purposes of clarity, one skilled in the art will appreciate that such objects 305, 309 may be printed over multiple sheets.

A scanning device 306, such as an optical scanner known in the art, records information from the objects 305, 309 on the sheet 304. According to an embodiment of the present invention, the scanning device 306 records reflectance of the objects 305, 309. However, one skilled in the art will appreciate that other types of information may be acquired by the scanning device 306. For example, one could measure the optical density of the objects. Unlike reflectance, which decreases as more and more of a white paper substrate is covered with ink, for example, optical density increases as more and more of a white paper substrate is covered with ink. A further example applicable to the case of printing on transparent media is the measurement of light transmission through the printed objects.

The scanning device 306 transmits scan information 307 it has acquired from the objects 305, 309 to the data processing system 308. The scanning device 306 may transmit the information 307 while the scan information 307 is being acquired or as a batch transmission after all of the scan information 307 has been acquired. Although shown separately from the scanning device 306, one skilled in the art will appreciate that the data processing system 308 and the scanning device 306 may be part of a single device.

The data processing system 308, instructed by computer-code stored in one or more computer-accessible memories, determines a TOE 314 based at least upon the scan information 307 and voltage information from a data storage system 310. (The phrase "turn-on-energy" (TOE) is used herein to generically refer to, for example, any mechanism used to facilitate causing ink to be ejected from a nozzle, such as a voltage, a pulsewidth, etc.) The voltage information may include data describing the energy levels, such as voltage levels, used to print the test objects 309.

The data processing system 308 may include one or more computers communicatively connected. The term "computer" is intended to include any data processing device, such as a desktop computer, a laptop computer, a mainframe computer, a personal digital assistant, a Blackberry, and/or any other device for processing data, and/or managing data, and/or handling data, whether implemented with electrical and/or magnetic and/or optical and/or biological components, and/or otherwise.

The data storage system 310 may include one or more computer-accessible memories. The data-storage system 310 may be a distributed data-storage system including multiple computer-accessible memories communicatively connected via a plurality of computers and/or devices. On the other hand, the data storage system 310 need not be a distributed data-storage system and, consequently, may include one or more computer-accessible memories located within a single computer or device.

The phrase "communicatively connected" is intended to include any type of connection, whether wired, wireless, or both, between devices, and/or computers, and/or programs in which data may be communicated. Further, the phrase "communicatively connected" is intended to include a connection between devices and/or programs within a single computer, a connection between devices and/or programs located in different computers, and a connection between devices not located in computers at all. In this regard, although the data storage system 310 is shown separately from the data processing system 308, one skilled in the art will appreciate that the data storage system 310 may be stored completely or partially within the data processing system 308.

The phrase "computer-accessible memory" is intended to include any computer-accessible data storage device, whether volatile or nonvolatile, electronic, magnetic, optical, or otherwise, including but not limited to, floppy disks, hard disks, Compact Discs, DVDs, flash memories, ROMs, and RAMs.

Figure 5:
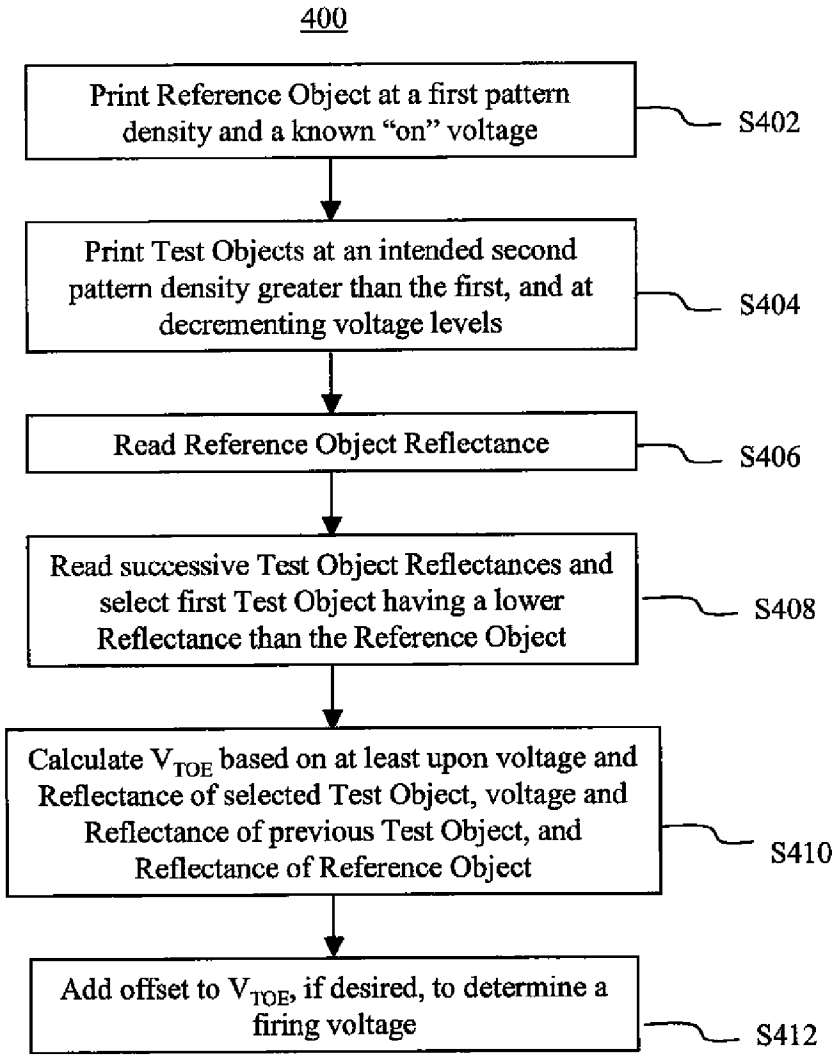
FIG. 5 illustrates a method for calibrating turn-on energy of a marking device, according to an embodiment of the present invention.

Having described the components of the system 300, according to an embodiment of the present invention, a method 400 in which such a system 300 operates, according to an embodiment of the present invention, will be described with reference to FIG. 5. Steps S402 and S404 in FIG. 5 illustrate the printing of the sheet 304 shown in FIG. 4. As described at step S402 in FIG. 5, the reference object 305 is printed at a first pattern density and a known "on" energy level, such as a voltage $V_o$. The known "on" energy level is an energy level at which all or most nozzles of the marking device 302 reliably fire. An example of such an energy level in a typical ink jet marking device is 28 volts or approximately 28 volts. At step S404 in FIG. 5, the marking device 302 prints the test objects 309 at an intended second pattern density greater than the first pattern density used to print the reference object. Further, each test object 309 is printed at a different voltage, thereby causing each test pattern to be produced by the firing of a particular percentage of selected nozzles.

Figure 1:
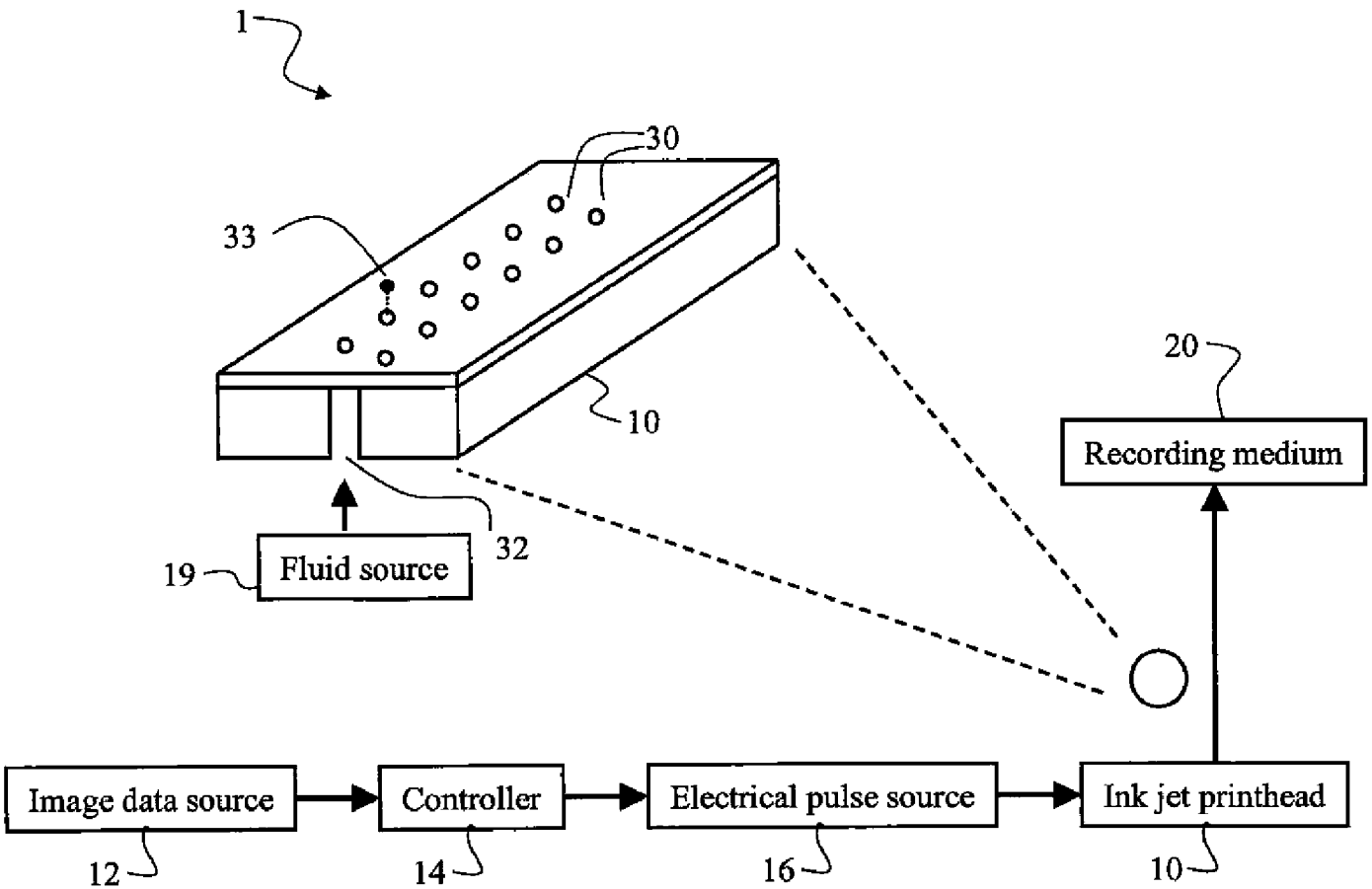
FIG. 1 (Prior Art)
FIG. 1 illustrates a conventional inkjet printing system.
Figure 2:
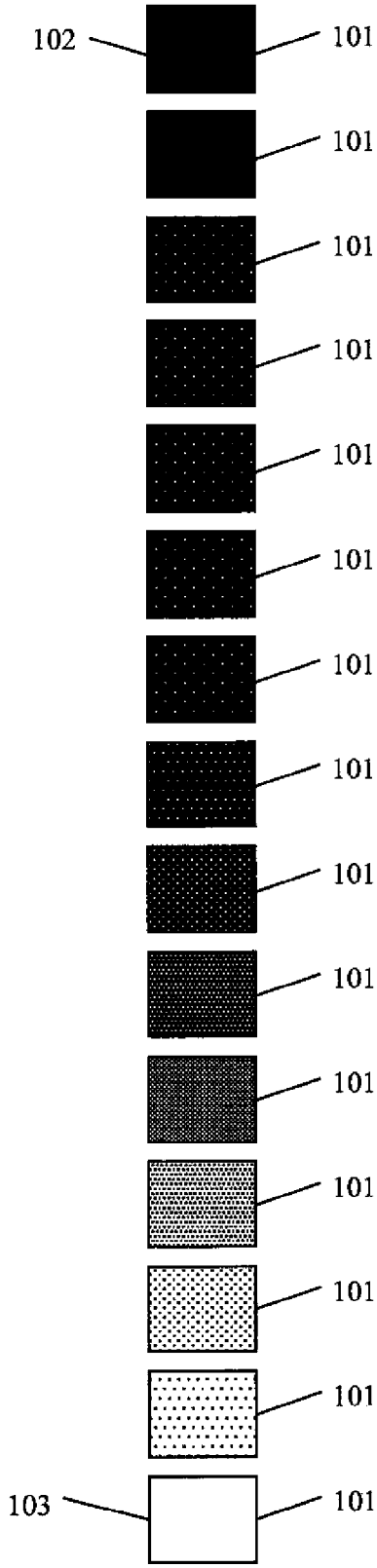
FIG. 2 (Prior Art)
FIG. 2 illustrates an example sequence of swatches printed according to a conventional scheme.
Figure 3:
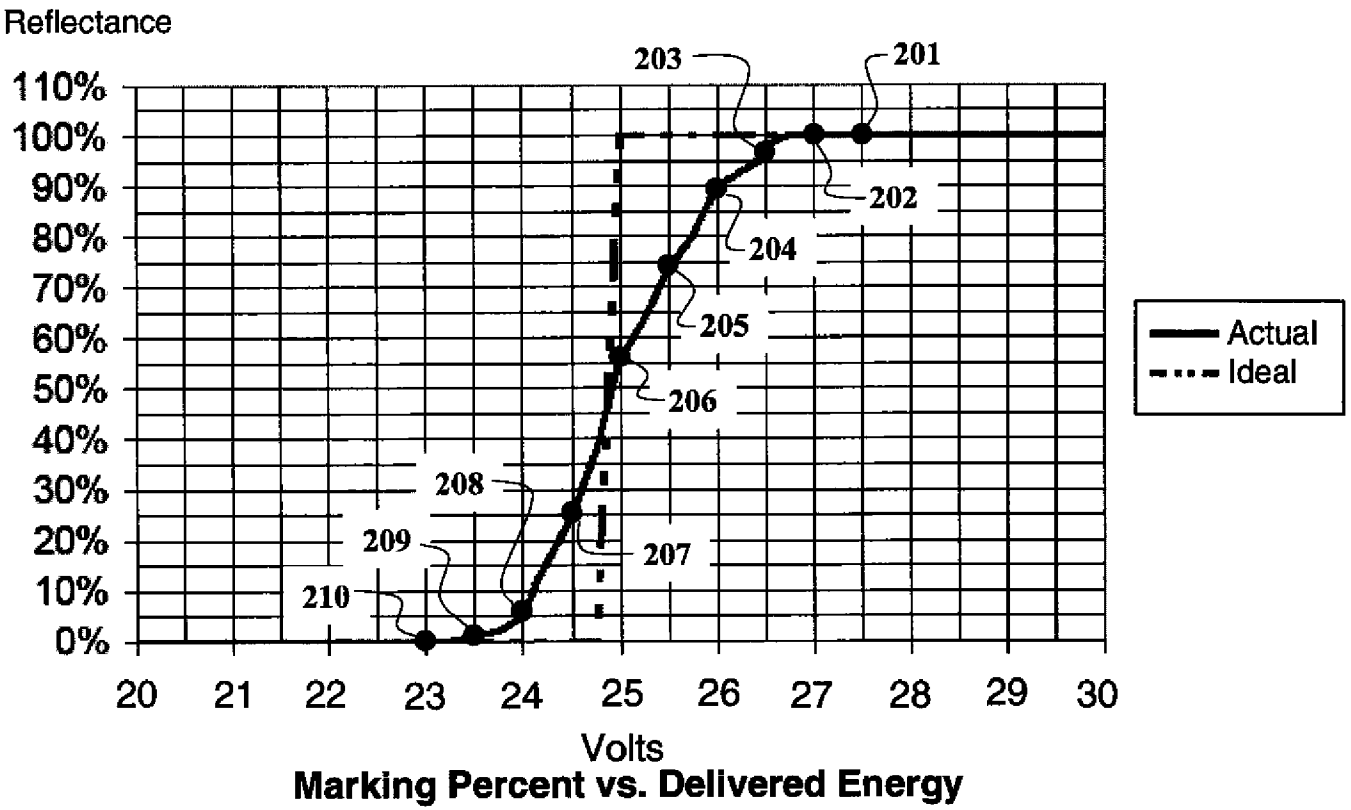
FIG. 3 illustrates an example voltage versus reflectance percentage plot.
Figure 6:
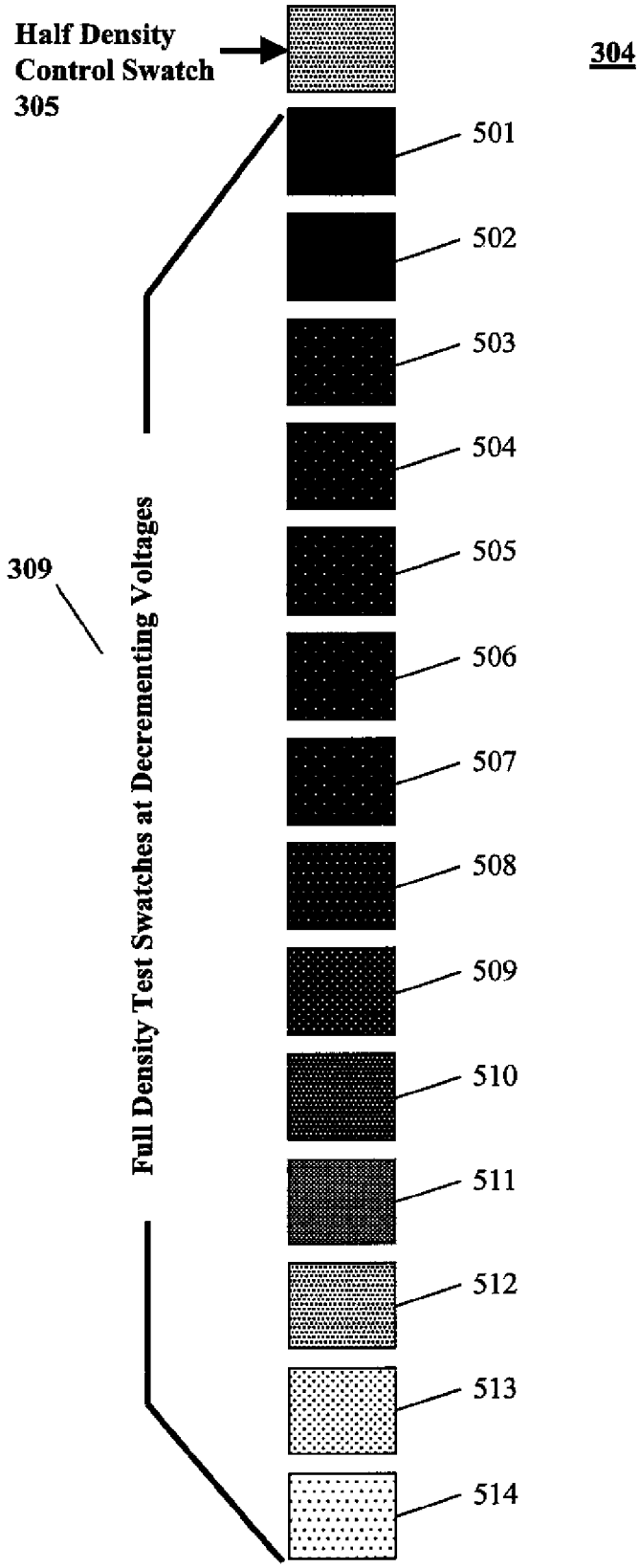
FIG. 6 illustrates a reference object followed by a sequence of test objects printed according to an embodiment of the present invention.
Figure 7:
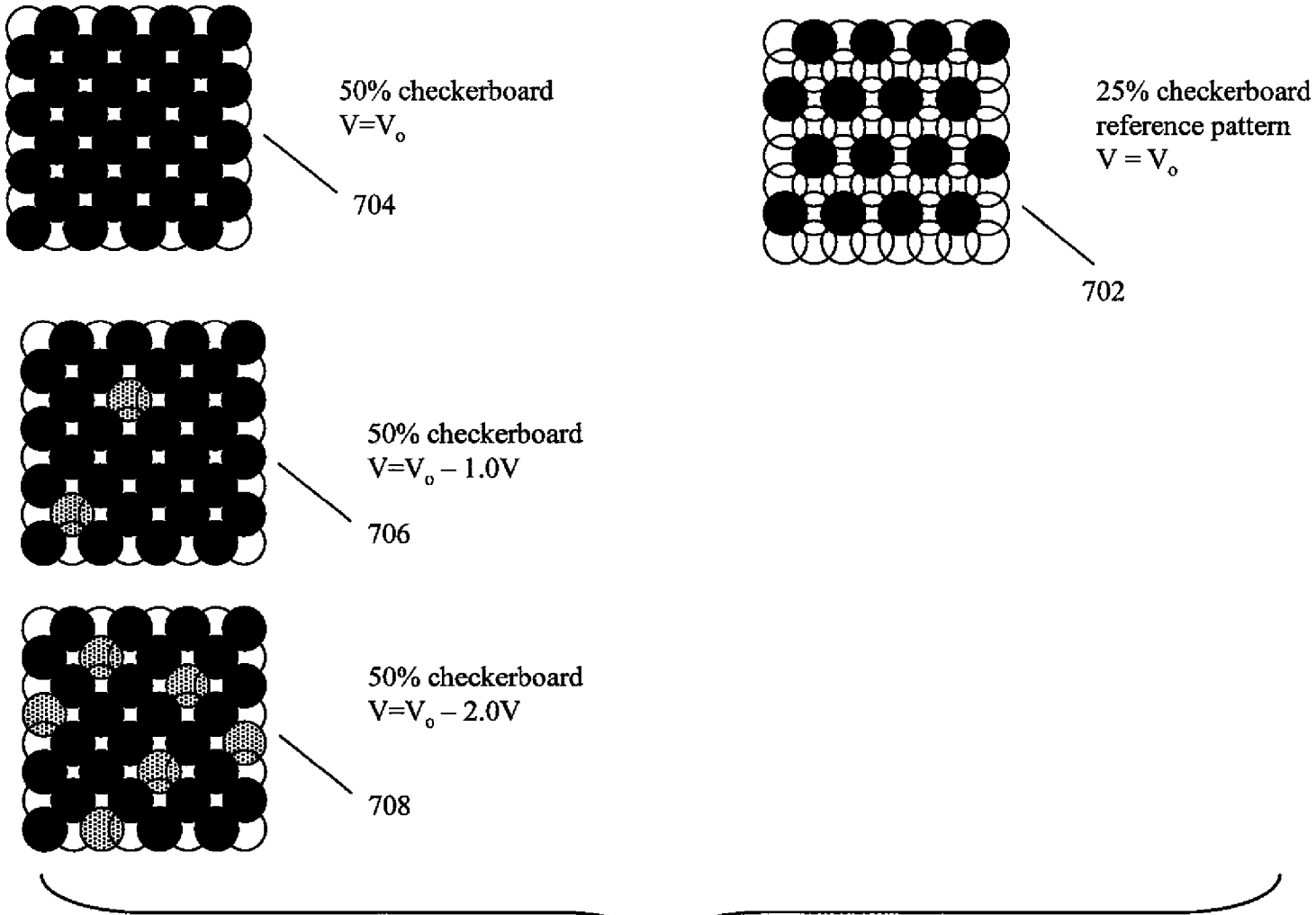
FIG. 7 illustrates a sequence of 50% checkerboard patterned test objects printed at successively lower voltages and a 25% checkerboard patterned reference object printed at a reference voltage, according to an embodiment of the present invention.
Figure 8:
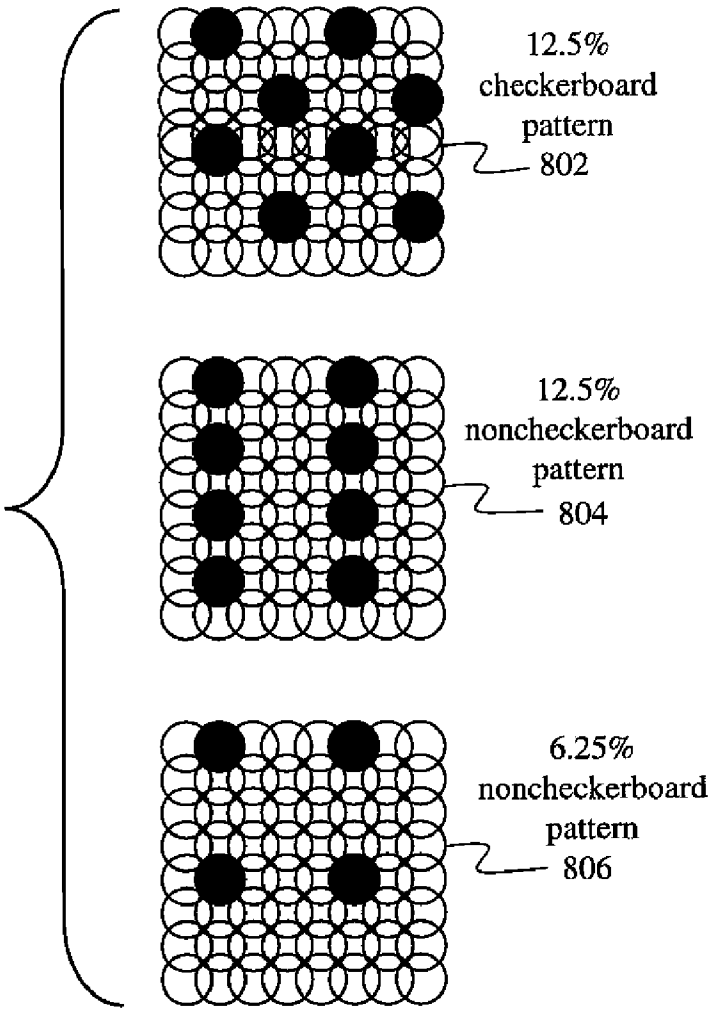
FIG. 8 illustrates examples of different test or reference object patterns and densities, according to embodiments of the present invention.

FIG. 6 provides an example of a sheet 304 produced according to one set of possible parameters that may be used. As with FIG. 2, it should be noted that the texture of the swatches shown in FIG. 6 is used merely to illustrate a change in reflectance of each swatch and is not used to illustrate exactly which nozzles fired and which did not. In the example of FIG. 6, the reference object 305 is a swatch produced at a known "on" voltage $V_o$ with a 12.5% density checkerboard pattern (i.e., 12.5% of all nozzles are fired, and the firing nozzles form a checkerboard pattern). Although this example uses a 12.5% density checkerboard pattern for printing the reference object, one skilled in the art will appreciate that other densities and patterns may be used. For example, FIG. 7 illustrated the use of a reference object 702, which is a swatch having a 25% density checkerboard pattern. Further, other reference pattern densities may be used other than ¼ or ⅛, such as 3/16, 1/16, etc. In addition, a checkerboard pattern is not required. Types of patterns for the reference object 305 may include regularly spaced printed pixels which have minimal or no overlap with the closest printed pixel. In this regard, FIG. 8 illustrates pattern densities 802, 804, 806 of 12.5% checkerboard, 12.5% noncheckerboard, and 6.25% noncheckerboard patterns, respectively. Further, although the reference object 305 is shown as a swatch in FIG. 6, one skilled in the art will appreciate that other objects may be used as well.

The sequence of test objects 309 in the example embodiment of FIG. 6 are produced contemporaneously or substantially contemporaneously on the same substrate (i.e., sheet 304) as the reference object 305. However, one skilled in the art will appreciate that the sequence of test objects 309 could be produced on one or more sheets, and could be on one or more sheets separate from the sheet on which the reference object 305 is printed. So long as the sheet(s) on which the test objects 309 are printed are of the same type as the sheet on which the reference object 305 is printed, the TOE calculation described herein will be fully or largely independent of effects caused by using different substrate types for calibrating different fluid-ejecting marking devices. Further, printing the reference object 305 contemporaneously or substantially contemporaneously with the test objects 309 allows the TOE calculation described herein to produce results fully or largely independent of effects caused by calibrating different fluid-ejecting marking devices under different ambient conditions, such as temperature and/or humidity. However, good TOE calibration results may still be achieved without printing the reference object 305 contemporaneously or substantially contemporaneously with the test objects 309, and, therefore, the invention is not limited to such contemporaneous or substantially contemporaneous printing.

In the example of FIG. 6, the sequence of test objects 309 are printed with a 25% density checkerboard pattern. As with the reference object 305, however, other densities and patterns may be used, so long as the test objects are printed with an intended pattern density greater than that of the reference object 305 if both were printed at the voltage $V_o$.

Also, the example of FIG. 6 includes individual test objects 501-514, each of which is printed at a successively lower energy level, such as a voltage level, than the previous test object. For example, the first test object 501 may be printed at a voltage $V_o$ known to fire all or nearly all of the nozzles of the marking device 302. The last test object 514 may be printed at a voltage known to fire none or few of the nozzles of the marking device 302. For example, the first test object 501 may be printed at a voltage of 27 volts, and each test object thereafter may be printed with a voltage 0.5 volts lower than the previous test object. In other words, the second test object 502 may be printed with 26.5 volts, the third test object 503 may be printed with 26 volts, etc. FIG. 7 provides an additional example, where reference numerals 704, 706, 708 represent test objects printed in a 50% checkerboard pattern that were printed with voltage levels that decrease by one volt from the previous test object. Black dots in FIG. 7 represent ink ejected from nozzles that properly fired, the shaded dots represent regions where ink should have been ejected from nozzles, and white dots represent regions where ink properly was not ejected from nozzles. As can be seen in FIG. 7, as the voltage is decremented for each test object, successively fewer of the intended printed pixels actually print.

Although FIG. 6 shows a linear sequence of test objects printed at successively lower voltages, one skilled in the art will appreciate that other arrangements (besides a linear arrangement) of objects may be used, and that each successively printed object may have, instead, an increasing voltage over the previous object. Further, the test objects may be printed without a linear progression of voltage changes. For example, the test objects could be printed in a grid where each test object is printed with a different voltage, but each test object does not necessarily have a fixed voltage separation from the test objects surrounding it. Furthermore, rather than varying the voltage used in printing the test objects, one may instead vary the pulse width or pulse waveform used in printing the test objects.

It should be noted that embodiments of the present invention often refer to different energy levels or different voltage levels used to print test objects 309, respectively. For cases in which the voltage is the parameter being changed for each test object 309 (while keeping pulsewidths constant), the energy is simply related to the voltage as indicated above.

Figure 9:
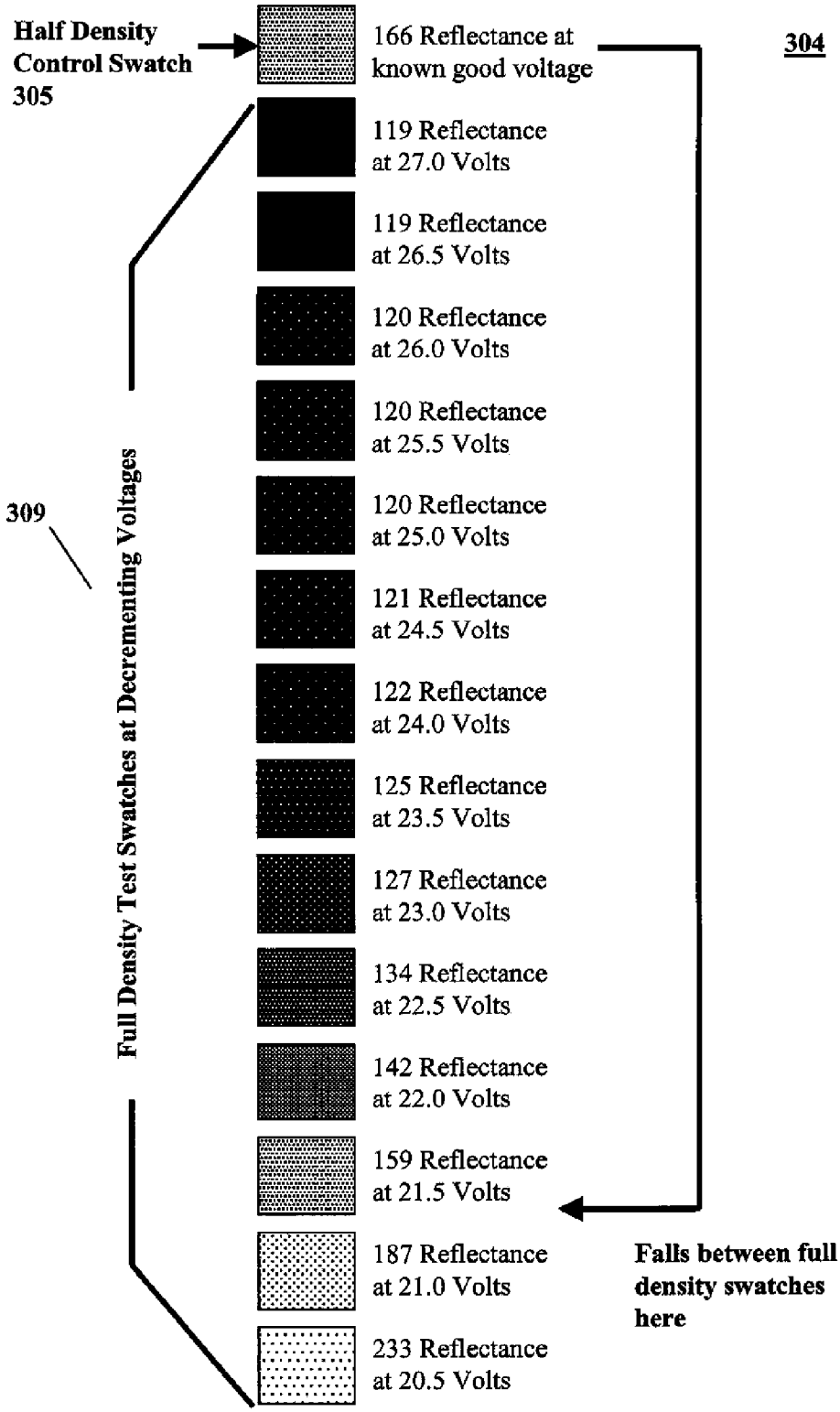
FIG. 9 illustrates a comparison of the test objects with the reference object from the example of FIG. 6, according to an embodiment of the present invention.

At step S406 in FIG. 5, a scanning device 306 reads the reference object 305 on the sheet 304 and extracts information therefrom. According to one embodiment of the present invention, the scanning device 306 extracts reflectance information from the reference object 305, which, as shown in the example of FIG. 9, is measured to be 166 reflectance units RU. At step S408, the scanning device 306 extracts information, such as the reflectances, from at least some of the test objects 309. As indicated previously, rather than using reflectance units, one could alternatively use optical density units, but equation 1 below would then need to be modified accordingly.

FIG. 9 illustrates examples of reflectances extracted from the test objects 309 by the scanning device 306. As with FIGS. 2 and 6, it should be noted that the texture of the swatches shown in FIG. 6 is used merely to illustrate changes in reflectances between the swatches and is not used to illustrate exactly which nozzles fired and which did not. In this regard, the texture of the swatches may not actually represent the reflectance values shown to the right of the swatches. Accordingly, the texture of the swatches are used merely as an illustration.

In addition, FIG. 9 shows the energy levels, such as voltage levels, used to print each of the test objects 309. The information 307 acquired by the scanning device 306 is transmitted to a data processing system 308. The data processing system 308 then identifies which of the test object(s) 309 closely resemble the reference object 305. In the embodiment of FIG. 6, the data processing system 308 identifies at least (a) the test object having the closest reflectance greater than the reflectance of the reference object 305, and (b) the test object having the closest reflectance less than the reflectance of the reference object 305. One way of identifying these two test objects is to order the test object reflectances from least to greatest, and then scan the reflectance of each test object, one at a time. The first test object to exhibit a reflectance greater than the reference object 305 is identified as being the test object having the closest reflectance greater than the reflectance of the reference object 305. In the example of FIG. 9, this test object is the object having a reflectance of 187 RU. The previous test object to the object having the closest reflectance greater than the reflectance of the reference object 305 is identified as being the test object having the closest reflectance less than the reflectance of the reference object 305. In the example of FIG. 9, this test object is the test object having a reflectance of 159 RU.

As shown at step S410 of FIG. 5, having identified the test objects resembling the reference object 305, TOE is determined according to the following equation (1):

$$V_{TOE}=V1+[(V1-V2)(R_{reference}-R1)]/(R1-R2) \quad (1)$$

where $V_{TOE}$ is a voltage associated with a calibrated turn-on energy. V1 is the energy level, such as the voltage used to print the test object having the closest reflectance R1 greater than the reflectance of the reference object 305. V2 is the energy level, such as the voltage used to print the test object having the closest reflectance R2 less than the reflectance $R_{reference}$ of the reference object 305. According to the example of FIG. 9 the TOE is calculated as follows:

$$V_{TOE}=21.5+[(21.5-21)(166-159)]/(159-187)=21.375V$$

$V_{TOE}$ indicates the energy level, such as the voltage needed to fire X percent of the nozzles of the marking device 302. X is calculated according to equation (2):

$$X=(D_{reference}/D_{test})*100 \quad (2)$$

where $D_{reference}$ is the pattern density used to print the reference object and $D_{test}$ is the pattern density used to print the test objects. In the example of FIGS. 6 and 9, $D_{reference}$ is 12.5% and $D_{test}$ is 25%. Accordingly, X=50% and $V_{TOE}$, in this example, indicates the voltage at which 50% of the nozzles fired. Therefore, it can be seen that the present invention allows an operator to define what $V_{TOE}$ represents by adjusting the densities used to produce the reference object 305 and the test objects 309, respectively.

In order to determine a firing energy level, such as a firing voltage, used to actually drive the printer 302, an offset, based upon characteristics of the marking device 302 and X from equation (2) above, may be added to $V_{TOE}$. The firing voltage is represented in FIG. 4 by reference numeral 312. The optional offset added at step S412, for example, may be an additional 10% of $V_{TOE}$. However, this offset depends upon X, from equation (2) above, and upon other factors, such as characteristics of the marking device 302.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

S402 step
S404 step
S406 step
S410 step
S412 step
1 printing system
10 printhead
12 image/image data source
14 driving circuit/controller
16 electrical pulse source
19 ink-reservoir/fluid source
20 substrate/recording medium
30 nozzles
32 channels
33 drops
101 swatches
102 first swatch
103 last swatch
201-210 points
300 system
302 marking device/printer
304 sheet
305 reference object
306 scanning device
307 transmission path/scan information
308 data processing system
309 test object
310 data storage system
312 firing voltage/reference numeral
314 turn-on energy
400 method
501-514 test objects
702 reference object
704 test object

706 test object
708 test object
802 pattern density
804 pattern density
806 pattern density

What is claimed is:

1. A method for facilitating calibration of turn-on energy of a fluid-ejecting marking device, the method comprising the steps of:

printing a reference object at a first energy level with the fluid-ejecting marking device, the reference object being printed on a substrate of a first type;

printing a plurality of test objects at different energy levels with the fluid-ejecting marking device, the plurality of test objects being printed on one or more substrates of the first type;

identifying one or more test objects of the plurality of test objects that resemble the reference object;

identifying one or more identified energy levels or identified data related to one or more energy levels used to print the one or more selected test objects;

calculating data pertaining to a turn-on energy for the fluid-ejecting marking device based at least upon the identified energy levels or identified data; and outputting the calculated data.

2. The method of claim 1, wherein the fluid-ejecting marking device is an ink jet marking device.

3. The method of claim 1, wherein the identified one or more energy levels or identified data pertains to one or more voltages.

4. The method of claim 1, wherein the reference object and the plurality of test objects each are swatches.

5. The method of claim 4, wherein the reference object and the plurality of test objects each have a checkerboard pattern.

6. The method of claim 1, wherein the reference object is printed at a first pattern density, and wherein the plurality of test objects each are printed at an intended second pattern density greater than the first pattern density.

7. The method of claim 6, wherein the first pattern density is approximately 12.5% density and the intended second pattern density is approximately 25% density.

8. The method of claim 6, wherein the intended second pattern density is twice or less than twice the first pattern density.

9. The method of claim 1, wherein the reference object and the plurality of test objects are printed contemporaneously or substantially contemporaneously.

10. The method of claim 1, wherein the reference object and the plurality of test objects are printed together on a single substrate.

11. The method of claim 1, wherein the plurality of test objects are printed in a row, each test object being printed with a successively lower energy level.

12. The method of claim 1, wherein the plurality of test objects are printed in a row, each test object being printed with a successively higher energy level.

13. The method of claim 1, wherein the one or more selected test objects resembles the reference object because the one or more selected test objects have closer reflectance to the reflectance of the reference object than do nonselected test objects.

14. The method of claim 1, wherein the one or more selected test objects comprise a first selected test object and a second selected test object.

15. The method of claim 14, wherein the first selected test object resembles the reference object because it has a closest reflectance greater than a reflectance of the reference object, and wherein the second selected test object resembles the reference object because it has a closest reflectance less than the reflectance of the reference object.

16. A system for facilitating calibration of turn-on energy of a fluid-ejecting marking device, the system comprising:

a fluid-ejecting marking device that prints (a) a reference object at a first energy level with the fluid-ejecting marking device, the reference object being printed by the fluid-ejecting marking device on a substrate of a first type, and (b) a plurality of test objects at different energy levels on one or more substrates of the first type;

a data storage system that, at least, retains data identifying one or more energy levels used by the fluid-ejecting marking device to print the plurality of test objects;

a scanning device that, at least, scans the one or more substrates upon which the reference object and at least some of the plurality of test objects that were printed by the fluid-ejecting marking device;

a data processing system that:

(a) receives scan information from the scanning device, the scan data describing information the scanning device acquired from scanning the substrates, (b) identifies one or more selected test objects of the plurality of test objects that resembles the reference object based at least upon the scan information;

(c) determines, utilizing the retained data retained by the data storage system, one or more identified energy levels or identified data related to one or more energy levels used to print the one or more selected test objects, (d) calculates calculated data pertaining to a turn-on energy for the fluid-ejecting marking device based at least upon the one or more identified energy levels or identified data, and (e) outputs the calculated data.

17. The system of claim 16, wherein the fluid-ejecting marking device is an ink jet marking device.

18. The system of claim 16, wherein the one or more identified energy levels pertains to one or more voltages.

19. The system of claim 16, wherein the reference object and the plurality of test objects each are swatches.

20. The system of claim 19, wherein the reference object and the plurality of test objects each have a checkerboard pattern.

21. The system of claim 16, wherein the reference object is printed by the fluid-ejecting marking device at a first pattern density, and wherein the plurality of test objects each are printed by the fluid-ejecting marking device at an intended second pattern density greater than the first pattern density.

22. The system of claim 21, wherein the first pattern density is approximately 12.5% density and the intended second pattern density is approximately 25% density.

23. The system of claim 21, wherein the intended second pattern density is twice or less than twice the first pattern density.

24. The system of claim 16, wherein the reference object and the plurality of test objects are printed by the fluid-ejecting marking device contemporaneously or substantially contemporaneously.

25. The system of claim 16, wherein the reference object and the plurality of test objects are printed by the fluid-ejecting marking device together on a single substrate.

26. The system of claim 16, wherein the plurality of test objects are printed by the fluid-ejecting marking device in a row, each test object being printed by the fluid-ejecting marking device with a successively lower energy level.

27. The system of claim 16, wherein the plurality of test objects are printed by the fluid-ejecting marking device in a row, each test object being printed by the fluid-ejecting marking device with a successively higher energy level.

28. The system of claim 16, wherein the selected one or more test objects resemble the reference object, as determined by the data processing system, because the one or more selected test objects have closer reflectance to the reflectance of the reference object than do nonselected test objects.

29. The system of claim 16, wherein the one or more selected test objects comprise a first selected test object and a second selected test object.

30. The system of claim 29, wherein the first selected test object resembles the reference object, as determined by the data processing system, because it has a closest reflectance greater than a reflectance of the reference object, and wherein the second selected test object resembles the reference object, as determined by the data processing system, because it has a closest reflectance less than the reflectance of the reference object.

* * * * *

UNITED STATES PATENT AND TRADEMARK OFFICE

CERTIFICATE OF CORRECTION

PATENT NO. : 7,510,259 B2
APPLICATION NO. : 11/613435
DATED : March 31, 2009
INVENTOR(S) : Derek Geer It is certified that error appears in the above-identified patent and that said Letters Patent is hereby corrected as shown below:

| | |
|---|---|
| Claim 1, Col. 9, line 17 | In Claim 1, after "more" insert --selected--. |
| Claim 1, Col. 9, line 24 | In Claim 1, before "energy" insert --one or more--. |
| Claim 16, Col. 10, line 24 | In Claim 16, after "the" insert --one or more--. |

Signed and Sealed this

Twenty-fifth Day of August, 2009

David J. Kappos

David J. Kappos
*Director of the United States Patent and Trademark Office*